US005174271A

United States Patent [19]

Seo

[11] Patent Number: 5,174,271

[45] Date of Patent: Dec. 29, 1992

[54] HEAT EXCHANGER WITH UNITARY AIR INTAKE AND EXHAUST MEMBER FOR AN AIR CONDITIONER

[75] Inventor: Kyong-Jin Seo, Kyonggi, Rep. of Korea

[73] Assignee: Samsung Electronics Co., Ltd., Kyungki, Rep. of Korea

[21] Appl. No.: 774,304

[22] Filed: Oct. 10, 1991

[30] Foreign Application Priority Data

Oct. 10, 1990 [KR] Rep. of Korea ..... 90-15518

[51] Int. Cl.[5] ..... P24H 3/02

[52] U.S. Cl. ..... 126/110 R; 126/99 R; 126/116 R; 165/159

[58] Field of Search ..... 126/110 R, 391, 360 R, 126/116 R, 99 R; 122/17, 75, 136 R, 19; 165/154, 155, 159, 161, 174

[56] References Cited

U.S. PATENT DOCUMENTS 3,358,672 12/1967 Dirk et al. ..... 126/110 R
3,774,587 11/1973 Mutchler ..... 126/110 R
3,813,039 5/1974 Wells ..... 126/110 R X
4,103,735 8/1978 Warner ..... 126/110 R X
4,309,978 1/1982 Hensiek et al. ..... 126/110 B
4,869,230 9/1989 Fletcher et al. ..... 126/91 A

FOREIGN PATENT DOCUMENTS 62-36029 9/1987 Japan .
63-11553 4/1988 Japan .

*Primary Examiner*—Larry Jones
*Attorney, Agent, or Firm*—Burns, Doane, Swecker & Mathis

[57] ABSTRACT

The present invention relates to a unitary heat exchanger for an air conditioner which is capable of minimizing the size, weight, and the power consumption thereof, and improving the thermal efficiency. The unitary heat exchanger comprises an air intake member for introducing the room air, and a combustion furnace for firing a fuel with the air introduced through the air intake member to generate a hot combustion gas. A heat exchanger is disposed in line with the furnace for passing the hot combustion gas from the combustion furnace therethrough and heating fresh room air supplied by a blower. An air exhaust member discharges the hot combustion gas from the heat exchange means.

7 Claims, 4 Drawing Sheets

HEAT EXCHANGER WITH UNITARY AIR INTAKE AND EXHAUST MEMBER FOR AN AIR CONDITIONER

BACKGROUND OF THE INVENTION

1. Field of the Invention

This invention relates to an air conditioner, and more particularly to a unitary heat exchanger used for an air conditioner.

2. Prior Arts

Conventional heat exchangers used for the air conditioner, for instance as disclosed in Japanese Utility Model Publications No. SHO 62-36029 or SHO 63-11553 has a construction as shown in FIG. 4. That is, air from a room introduced through an inlet 5 is mixed with a fuel which is injected by a burner motor 4 mounted on a support panel 7.

The mixture of the air and the fuel is introduced into a combustion furnace 2 through a burner 6 and a connecting duct 8 and becomes incinerated therein. Upon the combustion operation, the generated combustion gas with high temperature is moved up through the heat exchanger 1 composed of a plurality of pipes juxtaposedly arranged therebetween. Then, the combustion gas is flowed into a warm air chamber 11, and discharged to the outdoor through an outlet 3 of the exhaust pipe(not shown). Here, the room air supplied by a blower(not shown) is heated during passing through the heat exchanger 1 in the form of heat convection.

Meantime, in the conventional heat exchanger constructed as above, the heat exchanger 1 and the combustion furnace 2 are installed in parallel, which increases the volume and weight of the heat exchanger 1, whereby the air conditioner can not be smaller in size. Also the air intake motor becomes larger to increase the power consumption, which is not economical. Moreover, the heat exchanger 1 is connected to the combustion furnace 2 through the connecting pipe 9, thereby the flow path of the hot combustion gas from the combustion furnace 2 to the heat exchanger 1 is long and complex. As a result, there arises a problem that it takes too much time for the hot combustion gas to be supplied to the heat exchanger 1, which deteriorates the heat exchanging efficiency at the heat exchanger 1.

SUMMARY OF THE INVENTION

Therefore, the present invention has been made in consideration of the above mentioned problems.

It is an object of the present invention to provide a unitary heat exchanger for an air conditioner which is capable of minimizing the size, weight, and the power consumption thereof and improving the thermal efficiency during the air conditioning operation.

To achieve the above object, the unitary heat exchanger in accordance with the present invention having a burner motor and a combustion burner, comprises an air intake member for introducing a room air, a combustion furnace for firing a fuel with the air introduced through said air intake member to make a hot combustion gas, a heat exchange means disposed in line with the furnace for passing said hot combustion gas from the combustion furnace therethrough and heating a fresh room air supplied by a blower, and an air exhaust member for discharging said hot combustion gas from said heat exchange means.

These and other objects and features of the invention will be more fully appreciated from the following detailed description when taken in conjunction with the accompanying drawings in which:

BRIEF DESCRIPTION OF THE DRAWINGS

FIG. 1(*b*) is a partially broken schematic front view illustrating an inner arrangement of FIG. 1(*a*) in which the front panel is removed;

FIG. 5 is a schematic front view of the conventional heat exchanger.

DETAILED DESCRIPTION OF THE PREFERRED EMBODIMENT

Now, a preferred embodiment of the unitary heat exchanger of the present invention will be described in detail with reference to the accompanying drawings.

Figure 1B:
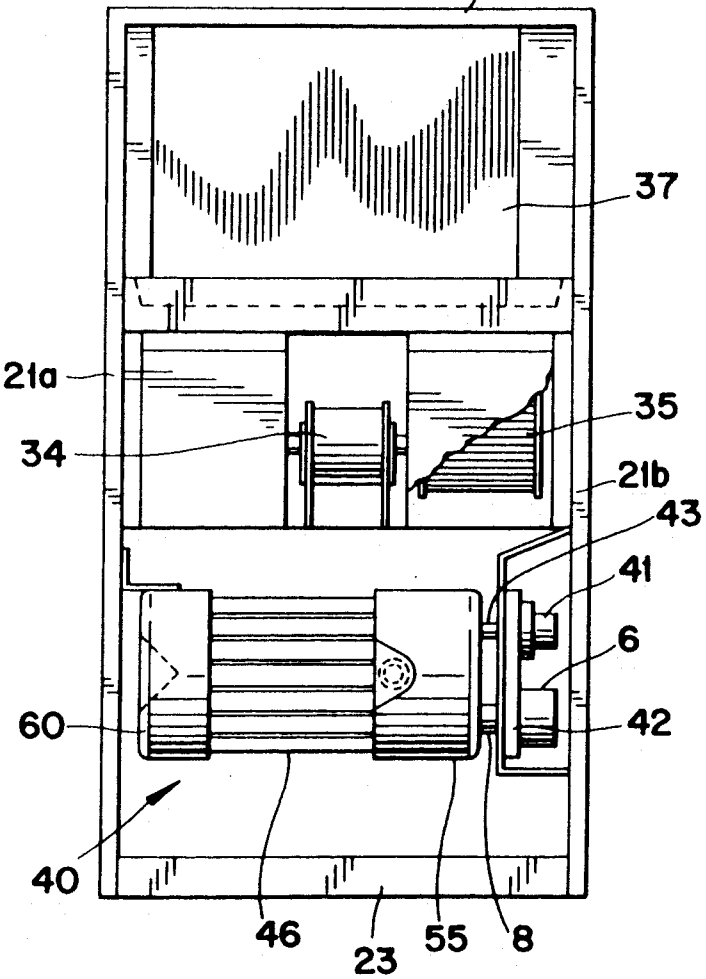
FIG. 1(*a*) is an exterior front view illustrating the air conditioner provided with the unitary heat exchanger in accordance with the present invention.
Figure 1A:
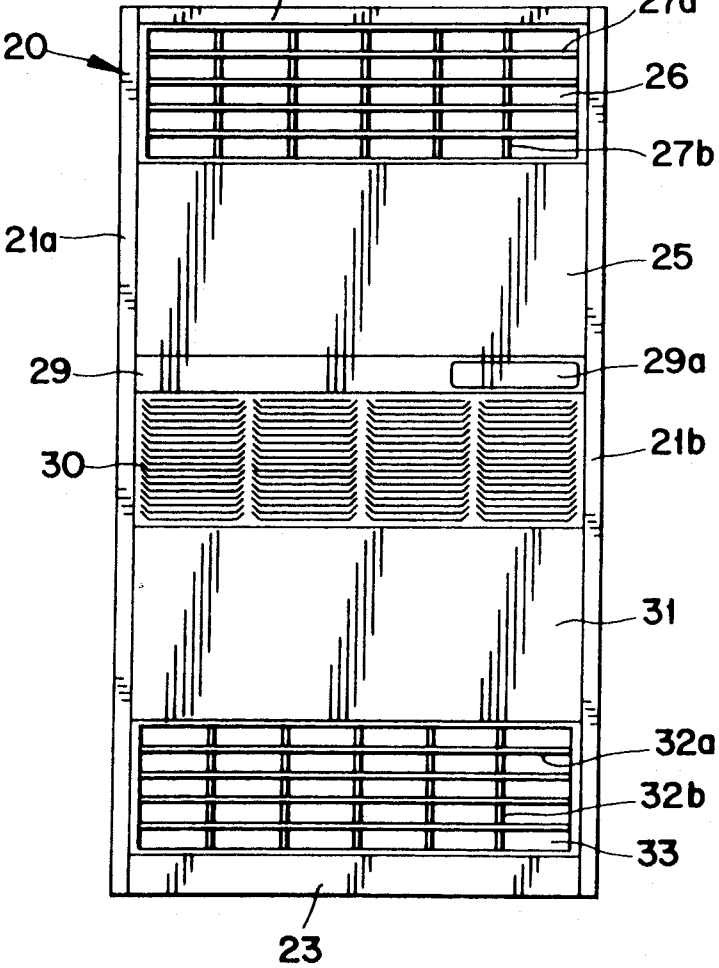

Referring to FIG. 1(*a*) and FIG. 1(*b*), an air conditioner 20 is provided with side plates 21*a* and 21*b* at the left and the right sides thereof. A bottom plate 22 and a top plate 23 are attached to the bottom part and the top part, respectively between the side plates 21*a* and 21*b* of the air conditioner 20. A front panel which is assembled with the side plates 21*a* and 21*b*, the bottom plate 22, and the top plate 23 includes a upper panel 25, an operating control panel 29 provided with an operation control unit 29*a* at one end, an air intake panel 30 for introducing a room air upon the operation of a blower 35 driven by a blower motor 34 which is mounted on a support member (not shown), and a lower panel 31.

The upper panel 25 and the lower panel 31 are, generally, shaped in a corresponding manner. The upper panel 25 is provided with an upper opening 26 in which a plurality of wind direction control plates 27*a* are pivotably installed for controlling the hot/cold wind upward or downward during the air conditioning operation. The lower panel 31 also is provided with a lower opening 33 in which a plurality of wind control plates 32*a* are pivotably installed for controlling the hot/cold wind to the right or the left during a heating operation.

The reference numeral 37 indicates the location for installing an air cooling system which is not an essential part of the present invention, an therefore detailed components of the air cooling system are not illustrated. In the interior space of the lower panel 31, the unitary heat exchanger according to the present invention is installed as shown in FIG. 1(*b*).

Next, the heat exchanger in accordance with the present invention will be described with reference to FIG. 3 and FIG. 4.

Figure 2A:
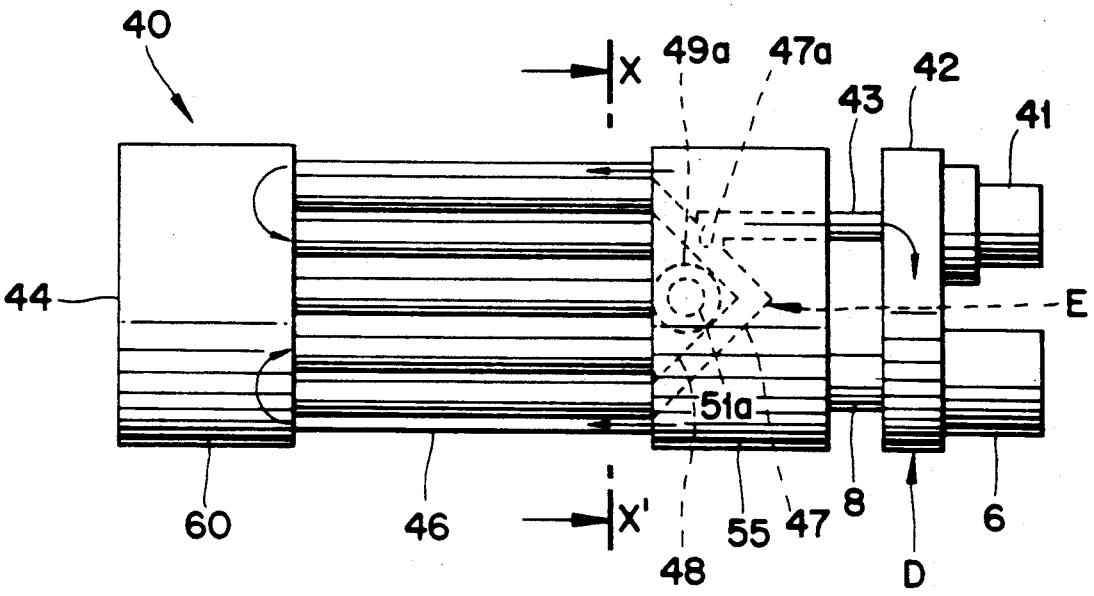
FIG. 2 is a schematic front view illustrating the unitary heat exchanger in accordance with one embodiment of the present invention.
Figure 2B:
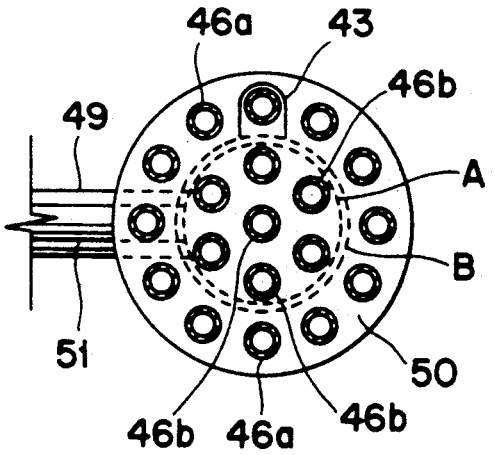
Figure 4:
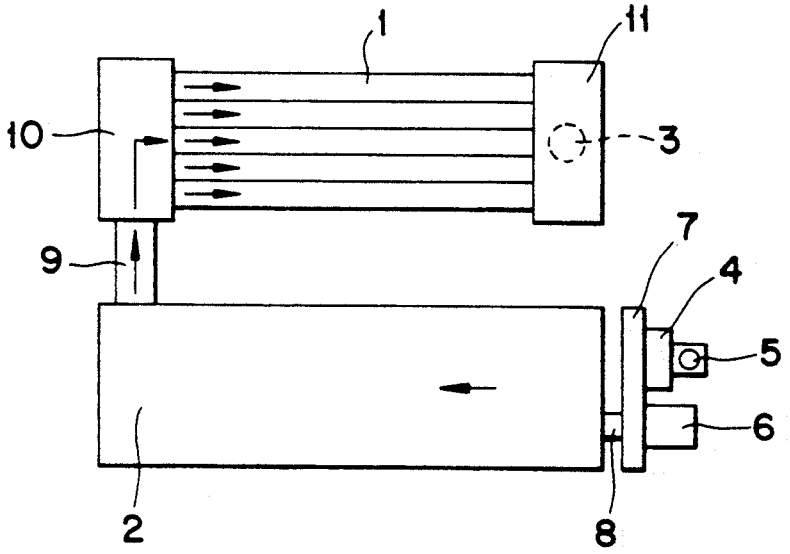
FIG. 4 (PRIOR ART)
FIG. 4 is an exploded perspective view of FIG. 2.

A heat exchanger main body 40, as shown in FIG. 2 and FIG. 4, comprises a heat exchanger drive member D for driving the heat exchanger, a baffle member for introducing or exhausting a combustion gas, a combustion furnace 55, a heat exchanger 46 having a plurality of intake side heat exchange pipes 46*a* and exhaust side heat exchange pipes 46*b* of stainless steel or copper, a warm air chamber 60 in cylindrical shape formed with through holes 60*a* for supporting ends of the pipes 46*a* and 46*b* and a closed surface 44 at an opposite end. The drive member D, heat exchanger 46, furnace 55 and warm air chamber are disposed in-line with one another.

The baffle member of the heat exchanger 46 comprises intake and exhaust baffles 47 and 48, an air intake pipe 49, an air intake tube 43, and an exhaust pipe 51.

The intake/exhaust baffles 47 and 48 are cone-shaped members and coaxially arranged. A room air is introduced through the intake buffle thereafter, fired with a fuel within the combustion furnace 55 to make a hot combustion gas, and the hot combustion gas is passed through the pipes 46*a* and introduced into the warm air chamber 60. Then the hot combustion gas is passed through the exhaust pipes 46*b* arranged interiorly of the intake pipes 46*a* to be discharged outwardly.

The air intake pipe 49 has a large diameter and its one end is airtightly secured, e.g. by welding, to a hole 47*b* formed on the inclined surface of the intake baffle 47 preventing leakage of an air and the other end is open to the atmosphere. One end of the air intake tube 43 is airtightly secured, e.g. by welding, to a hole 47*a* formed on the inclined surface of the intake baffle 47 perpendicular to the air intake pipe 49 and the other end of the air intake tube 43 is airtightly connected to a throughhole 42*a* of a support panel 42 of the heat exchanger drive member.

The exhaust pipe 51 having smaller diameter than that of the intake pipe 49 is provided with an outlet 51*a* and is coaxially installed within the intake pipe 49. One end of the exhaust pipe is airtightly secured, e.g. by welding, to a throughhole (not shown) of the exhaust baffle 48 and the other end of the exhaust pipe 51 is open to the atmosphere.

Here, the intake baffle 47, the intake pipe 49 and the intake tube 43 constitute an air intake member. Also the exhaust buffle 48 and the exhaust pipe 50 constitute an air exhaust member.

In addition, the combustion furnace 55 comprises a support panel 50 having a plurality of support holes 50*a* and 50*b* which receive respective ends of the intake/exhaust side heat exchange pipes 46*a* and 46*b* by welding. The panel 50 is attached to a cylindrical portion 54 having a throughhole 54*a* at a side surface in which the air intake pipe 49 is passed through. A disc-shaped side plate 52 secured at one side surface of the cylindrical portion 54 has a throughhole 52*a* for passing through the air intake tube 43 and a receiving pipe 52*b* for airtightly receiving the connecting duct 8 of the heat exchanger drive member.

The heat exchanger drive member D comprises a support panel 42 having the hole 42*a* for airtightly securing the one end of the air intake tube 43, the connecting duct 8 which is sealingly inserted within the receiving pipe 52*b* of the combustion furnace 55, a burner motor 41 mounted on the upper side of the support panel 42 for injecting the fuel, and a burner 6 for mixing an intake air with the fuel injected by the burner motor 41 and firing the mixture of the air and the fuel.

In the meantime, the assembling procedure of the baffle member E is described below.

Figure 3:
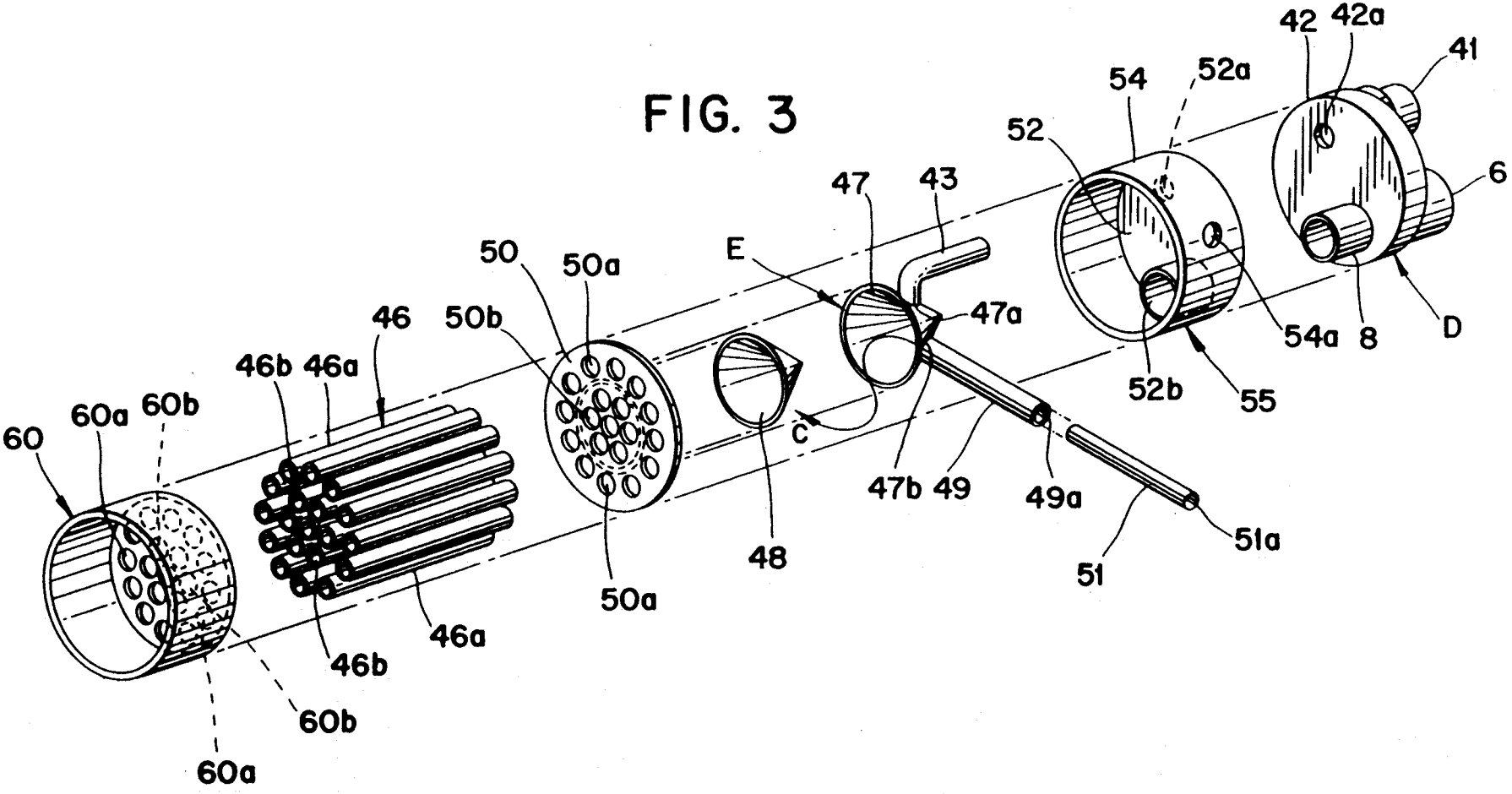
FIG. 3 is a sectional view taken along the line X-'X' of FIG. 2.

Firstly, as shown in FIG. 2, 3 and FIG. 4, the intake and exhaust baffles, 47, 48 are welded at the predetermined portions marked in dotted lines B and A of the support panel 50, the exhaust pipe 51 is welded at a hole (not shown) formed at the inclined surface of the exhaust buffle 48 as shown by arrow C. The air intake pipe 49 and the air intake tube 43 are welded at holes 47*b* and 47*a* formed at the inclined surface of the intake buffle 47, and then the air intake pipe 49 is airtightly secured at the throughhole 54*a* formed at the cylindrical portion 54 of the combustion furnace 55.

Next, the support panel 50 is airtightly welded at the left periphery of the cylindrical portion 54 of the combustion furnace 55, and the side plate 52 which is provided with the throughhole 52*a* and the receiving pipe 52*b* is airtightly welded at the right periphery of the cylindrical portion 54 of the combustion furnace 55.

It is convenient the assemblying procedure that the air intake pipe 49 is secured to the throughhole 54*a* before the support panel 50 and the side plate 52 are welded to the opposite peripheries of the cylinderical portion 54. Moreover, it is preferable that the throughholes (not shown) on the inclined surface of the exhaust baffle 48 and the holes 47*a* and 47*b* on the inclined surface of the intake baffle 47 are threaded in order to connect the ends of the air intake/exhaust pipes 49 and 51, thereby enhancing the assemblying efficiency thereof.

The operation of the unitary heat exchanger in accordance with the present invention constructed as above will be described hereinafter.

Upon the operation of the burner motor 41, the room air is introduced into the inlet 49*a* of the air intake pipe 49, passed sequentially through the intake baffle 47, the air intake pipe 43, and the connecting duct 8, and introduced into the combustion furnace 55. The air is mixed with the fuel to be fired within the combustion furnace 55.

The hot combustion gas generated from the combustion action within the combustion furnace 55 is flowed into the heat exchange pipes 46*a* formed around the outer portion of the support panel 50. During the flowing motion of the hot combustion gas through the pipes 46*a*, a room air supplied by the blowing action of the blower 35 is heated in a convective heat transfer manner.

After heat exchanging through the heat exchanger 46, the hot combustion gas whose temperature has be lowered to some extent is introduced into the warm air chamber 60, and entered into the heat exchange pipes 46*b* and passed through toward the exhaust buffle 48. At this time, the fresh room air supplied by the blower 35 is reheated in a convective heat transfer manner by the hot combustion gas flow through the pipes 46*b*. Then the hot combustion gas in the pipes 46*b* whose temperature has been considerably lowered is flowed through the exhaust baffle 48 into the exhaust pipe 51 having the outlet 51*a* at its end and discharged outwardly.

Meanwhile, the room air supplied by the blower 35 is heated to a high temperature owing to the heat exchanging action between the pipes 46*a* and 46*b* of the heat exchanger 46 and discharged through the lower opening 33 formed at the lower panel 31 to increase the room temperature.

As described above, according to the unitary heat exchanger of the present invention, the intake/exhaust baffles are installed within the combustion furnace and the air intake/exhaust pipes are coaxially arranged, whereby the air intake/exhaust system can be made in compact construction, light in weight, and minimized in size. Moreover, it is noted that the power consumption may be lowered due to the smaller size of construction of the heat exchanger.

In addition, it will be appreciated that the thermal efficiency of the heat exchanger may be improved because the room air supplied by the blower is apt to be repeatedly heated by means of the intake/exhaust side heat exchange pipes and also the distance between the combustion furnace and the heat exchanger is shortened.

The foregoing disclosure and description of the invention is illustrative and explanatory thereof, and various changes in the size, shape and materials, as well as in the details of the illustrated construction, may be made within the scope of the appended claims without departing from the spirit of the invention.

What is claimed is:

1. A heat exchanger for an air conditioner having a burner motor and a combustion burner, comprising: .

an air intake member for introducing intake air;

a combustion furnace for firing a fuel with the intake air to generate a hot combustion gas;

heat exchange means for exchanging heat between said hot combustion gas and fresh room air, said heat exchange means comprising conduits arranged in-line with said combustion furnace such that longitudinal axes of said conduits intersect said combustion furnace, said conduits arranged for conducting hot combustion gas from an end of said combustion furnace in a first axial direction and then back toward said end of said combustion furnace in a second axial direction; and means within said combustion chamber for introducing combustion gas into some of said conduits in the first axial direction a gas exhaust member disposed at said end of said combustion furnace for receiving and exhausting combustion gas from the remaining conduits from along a second axial direction.

2. Apparatus according to claim 1, wherein said gas exhaust member is positioned within said air intake member.

3. Apparatus according to claim 2, wherein said air intake member is positioned within said combustion furnace.

4. Apparatus according to claim 3, wherein said air intake member includes an air intake baffle, and said gas exhaust member includes a gas exhaust baffle disposed within said air intake baffle, a heat exchanger driving member being connected to said air intake baffle and said combustion furnace for circulating intake air to said combustion furnace, said air intake member including an air intake tube extending within said combustion furnace from said air inlet baffle to said heat exchanger driving member for conducting intake air to the latter.

5. Apparatus according to claim 3 including an air intake pipe connected to said air intake member for conducting intake air thereto, and a gas exhaust pipe connected to said gas exhaust member for exhausting gas therefrom; said gas exhaust tube being positioned inside of said air intake pipe.

6. Apparatus according to claim 1, wherein said conduits comprise spaced-apart first heat exchange pipes for conducting hot combustion gas from said end of said combustion furnace, and spaced apart second heat exchange pipes which conduct hot combustion gas back toward said end of said combustion furnace, said second heat exchange pipes encircling said first heat exchange pipes, said gas exhaust member occupying a central portion of said end of said combustion furnace and being disposed within said air intake member, said second heat exchange pipes communicating with said gas exhaust member.

7. Apparatus according to claim 1, wherein said gas exhaust member includes an air exhaust baffle mounted at said end of said combustion furnace, said air intake member including an air intake baffle which is spaced from said gas exhaust baffle such that a space is formed between said gas exhaust baffle and said air intake baffle for conducting said intake air.

* * * * *